United States Patent [19]

Rouly et al.

[11] Patent Number: 4,498,386

[45] Date of Patent: Feb. 12, 1985

[54] SILK SCREEN PRINTING MACHINE

[75] Inventors: Eric Rouly, Saint-Maur; Jean-Pierre Douville, Gagny, both of France

[73] Assignee: Societe d'Exploitation des Machines Dubuit, Paris, France

[21] Appl. No.: 501,878

[22] Filed: Jun. 7, 1983

[51] Int. Cl.[3] ..... B41F 17/22

[52] U.S. Cl. ..... 101/40; 101/126

[58] Field of Search ..... 101/38 R, 38 A, 39, 101/40, 126

[56] References Cited

U.S. PATENT DOCUMENTS 4,122,768 10/1978 Dubuit ..... 101/39

FOREIGN PATENT DOCUMENTS 2453064 5/1975 Fed. Rep. of Germany ..... 101/126

2714652 10/1977 Fed. Rep. of Germany ..... 101/126

2821751 11/1979 Fed. Rep. of Germany .... 101/38 R

*Primary Examiner*—Clifford D. Crowder

*Attorney, Agent, or Firm*—Charles E. Brown

[57] ABSTRACT

A machine comprises, to feed a printing station, a conveyor comprising spaced supports each adapted to support an object to be printed and, at said printing station, a screen carried by a carriage, a squeegee carried by a carriage, and a block adapted, by bearing the object to be printed, to control its angular orientation around its axis, this block being keyed in rotation to a lever which, by virtue of engagement means adjustable in position lengthwise, meshes with a carriage mounted for movement in synchronism with the squeegee.

10 Claims, 11 Drawing Figures

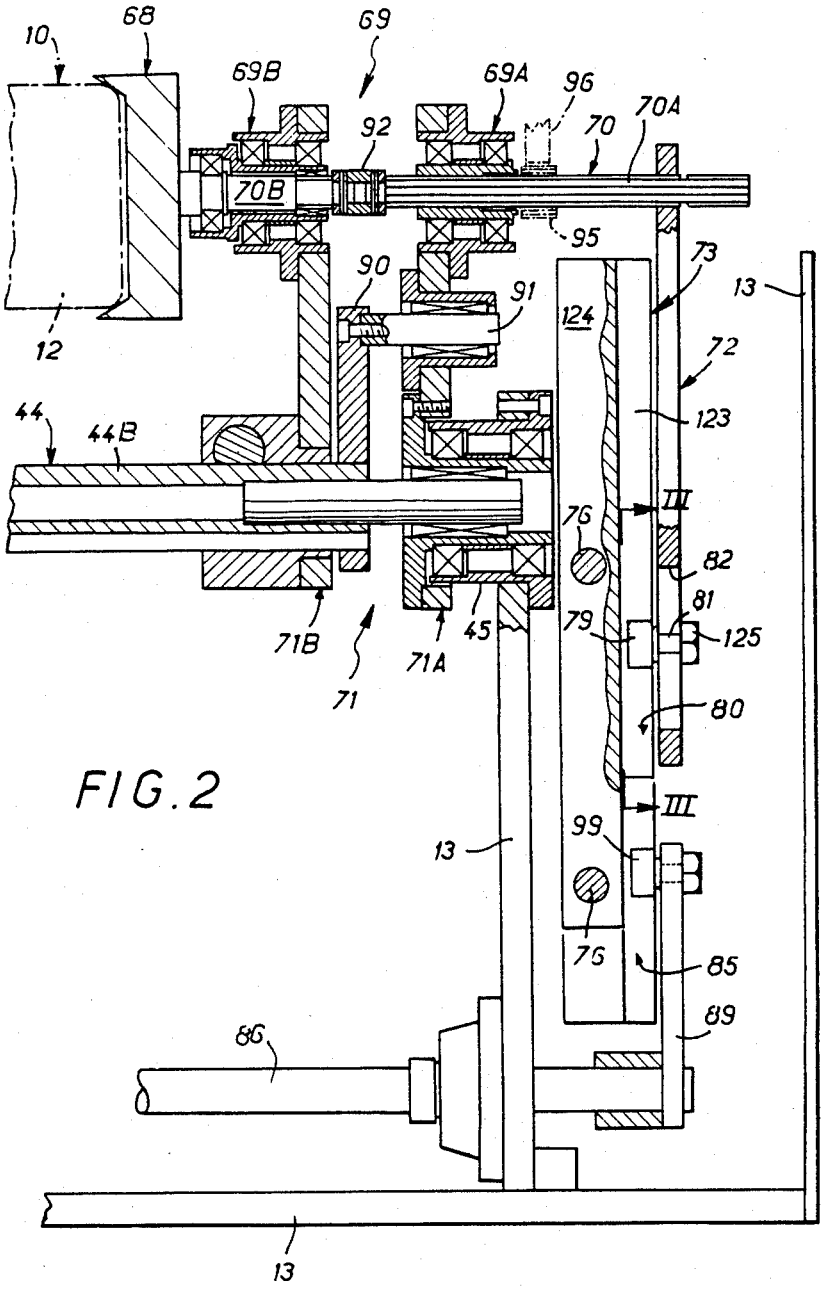
FIG. 2
FIG. 3
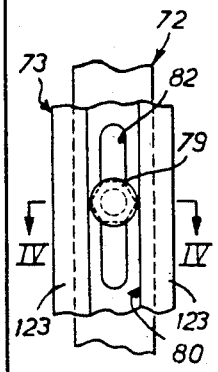
FIG. 4
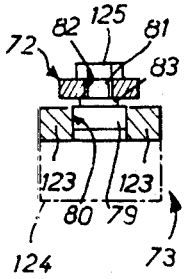

SILK SCREEN PRINTING MACHINE

The present invention is generally concerned with silkscreen printing machines, and is more particularly directed towards those which are particularly, but not exclusively, intended for printing objects which are oval in transverse cross-section, such as bottles, for example.

As is known, a silkscreen printing machine generally comprises, at one or more printing stations, on the one hand a screen, forming a stencil, and on the other hand a squeegee mounted movably transversely of the screen so as to be moved away therefrom during its return movement, between two printing operations.

More often than not, the screen is carried by a screen support carriage which is mounted to be movable to-and-fro on a guide, and the same applies to the squeegee.

Also more often than not, the printing station is served by a conveyor which carries spaced workholders each adapted to support an object to be printed and which runs in an endless loop around at least two direction changing members at least one of which is a driving member.

This conveyor may be advanced stepwise, the objects being printed in turn as it halts.

It may also be advanced continuously, however, and it has been proposed, to this end, to pass the conveyor around a circular direction changing member at the printing station, in cooperation with rotational drive means which, adapted to successively operate in isolation on each of the objects to be printed so as to rotate same at least partially on itself during its printing, are mounted so as to be movable to-and-fro between two extreme positions along the conveyor, so as to be able to accompany the latter over part of its movement, in synchronism therewith.

Thus, as it is printed, each of the objects concerned is moved along a circular path whose radius, hereinafter referred to for convenience as the radius of gyration, is equal to that of the corresponding direction changing member of the conveyor.

An arrangement of this kind is well-suited to the printing of objects which are cylindrical in transverse cross-section.

It is sufficient for the rotary block which normally, and for the purposes of application to the object to be printed, forms part of the rotational drive means provided to rotate the object at least partially on itself during its printing, hereinafter referred to for convenience as the bearing block, to be keyed to a gear itself meshing with a fixed rack curved to the corresponding radius of gyration, and for the screen to be conjointly subject to a compensatory movement transverse to its path and conforming to the path of the object.

On the other hand, an arrangement of this kind is not of itself suited to objects having an oval transverse cross-section, except in the particular case where the radius of curvature of the face of the object to be printed is strictly equal to the sum of the radius of gyration and half its thickness.

In this case, everything proceeds as if this face formed part of a cylinder centered on the axis of the corresponding direction changing member of the conveyor, hereinafter referred to for convenience as the gyration axis, and the object in question can then be developed in a suitable manner by virtue of this face in contact with the screen, by simple rolling against the latter, without even any rotation on itself, the associated bearing block controlling its angular orientation around its axis, and even without compensatory movement of the screen transversely to its path, the squeegee conjointly remaining in line with said gyration axis.

This does not apply, however, if the radius of curvature of the face to be printed of the object of oval transverse cross-section is greater than or less than the sum of its radius of gyration and half its thickness.

This radius of curvature varies from one object to another.

It would therefore be necessary to modify the radius of gyration for each object so as to adapt it to its radius of curvature.

In practice, in silkscreen printing machines at present adapted to the processing of objects with oval transverse cross-sections and equipped with a continuous feed conveyor for transporting these objects, it is necessary, in order to change from an object of a particular radius of curvature to an object of different radius of curvature, to change various component parts specifically adapted to the radius of curvature of the objects to be treated.

The resulting arrangements are relatively complex and costly, also necessitating relatively long adjustment times.

It is for this reason that at present, more often than not, silkscreen printing machines adapted to process objects of oval transverse cross-section are equipped with discontinuous feed conveyors, with all the attendant limitations with regard to their rate of production.

A general object of the present invention is an arrangement which can overcome these difficulties in a relatively simple manner, and which in particular can be adapted relatively easily to the printing of objects with overall transverse cross-sections of different radii of curvature, even though equipped with a continuous feed conveyor.

More precisely, an object of the present invention is a silkscreen printing machine of the kind comprising, to feed at least one printing station, a conveyor carrying at least one workholder adapted to support an object to be printed and, at said printing station, a screen, which is carried by a screen support carriage which is mounted to be movable to-and-fro on a guide, a squeegee, which is carried by a squeegee support carriage which is mounted to be movable to-and-fro on a guide parallel to the aforementioned guide, and a block, which is hereinafter referred to for convenience as the bearing block and adapted, by bearing on the object to be printed, to control its angular orientation relative to an axis transverse to the screen support carriage and squeegee support carriage guides, said bearing block being keyed to a lever so as to rotate therewith, which lever, by virtue of engagement means adjustable in position lengthwise, meshes with a control carriage mounted movably on a guide in synchronism with the squeegee support carriage.

In practice, engagement means of this kind are simply constituted by a pin, a roller, for example, freely engaged in a slideway which the associated carriage carries for this purpose.

Be this as it may, engagement means of this kind materialize, in accordance with the invention, the center of curvature of the face to be printed of the objects of oval transverse cross-section concerned.

All that is then necessary is to adjust the position on the lever carrying them of the engagement means through which this lever meshes with its control carriage, according to the radius of curvature of said face, and to appropriately offset these engagement means laterally.

Once this simple and fast adjustment has been carried out, each of the objects to print can, as previously, be developed by its corresponding face in contact with the silkscreen on displacement of the latter with a slight degree of rotation on itself.

In practice, the present invention is especially suited to the case where, at the printing station, the conveyor, which is of the continuous feed type, passes over a circular direction changing member.

By then combining the corresponding gyratory movement of the objects to print around the axis of this direction changing member with the rotation of these objects on themselves during their printing, the machine in accordance with the invention enables a linear contact movement between these objects and the silkscreen to be achieved, guaranteeing correct printing of the objects.

Finally, if desired, the printing machine in accordance with the invention may be adapted, not only to print objects to be printed of oval transverse cross-section, irrespective of the radius of curvature of the face thereof to be printed, within a wide range, but also (subject to a quick and easy adaptation) to the printing of objects of circular transverse cross-section.

The characteristics and advantages of the invention will emerge from the following description, given by way of example and with reference to the accompanying diagramatic drawings, in which:

FIG. 2 is a partial view of this machine in cross-section on the line II—II in FIG. 1;

FIG. 3 is another view of it in partial cross-section on the line III—III in FIG. 2;

FIG. 4 is another view of it in partial cross-section on the line IV—IV in FIG. 3;

Figure 1:
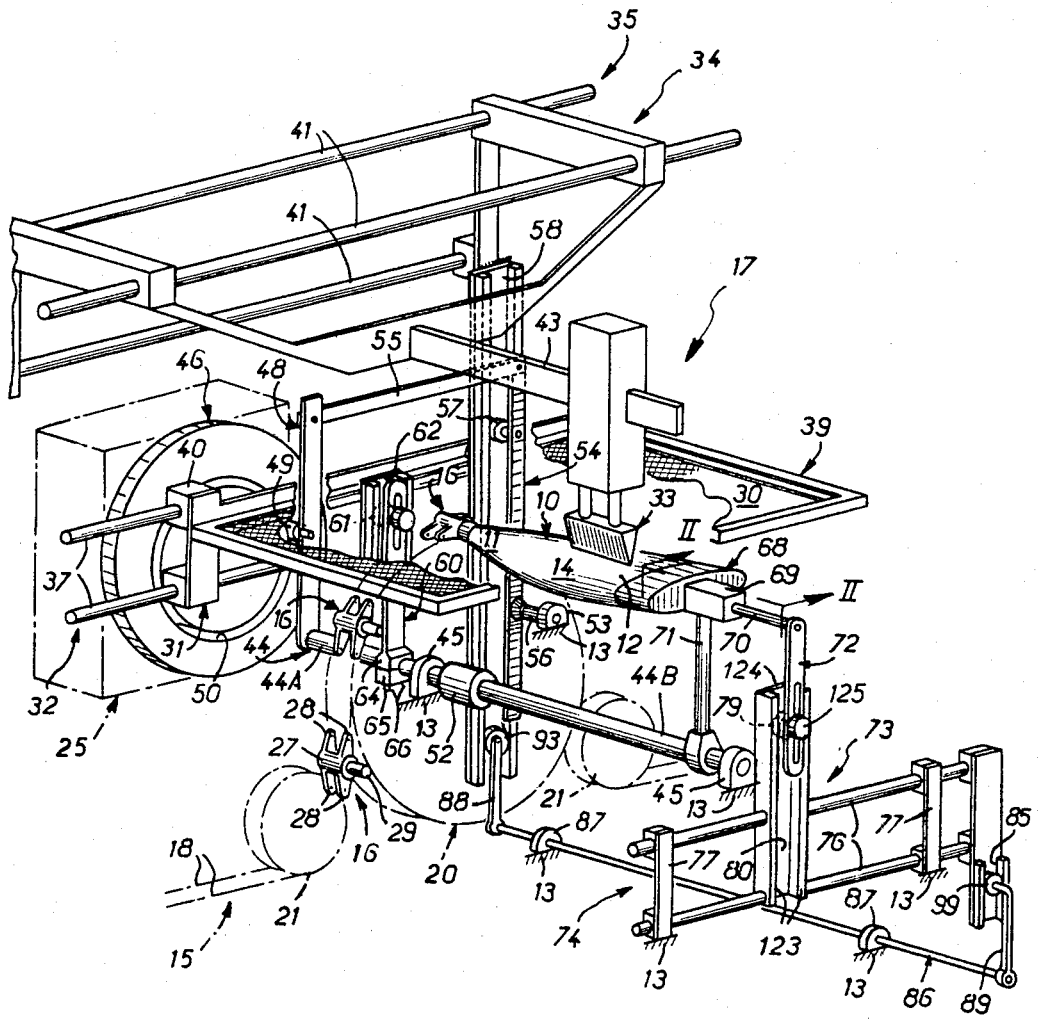
FIG. 1 is a perspective view showing, in essentially schematic terms, the various movable component parts of a printing machine in accordance with the invention.
Figure 5A:
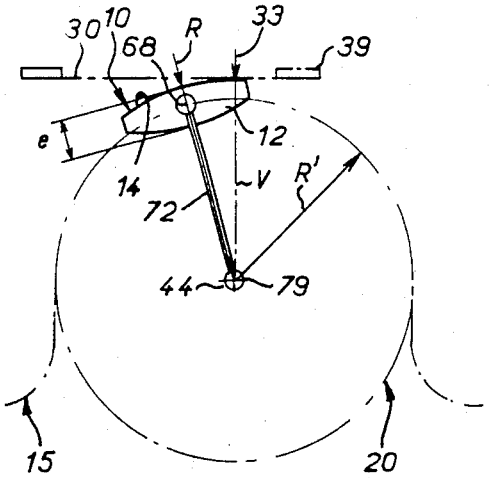
FIGS. 5A and 5B are diagrams illustrating the operation of the printing machine in accordance with the invention for an object to be printed of oval transverse cross-section and of particular radius of curvature.
Figure 5B:
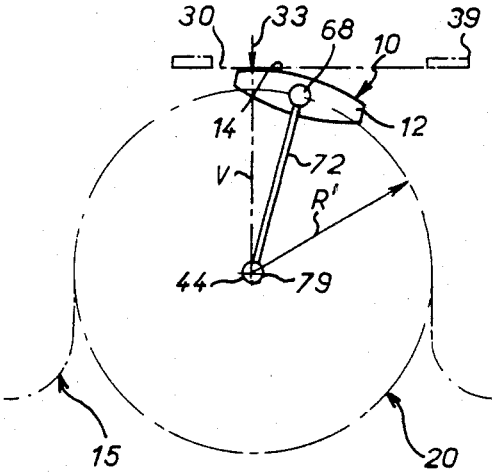
Figure 6A:
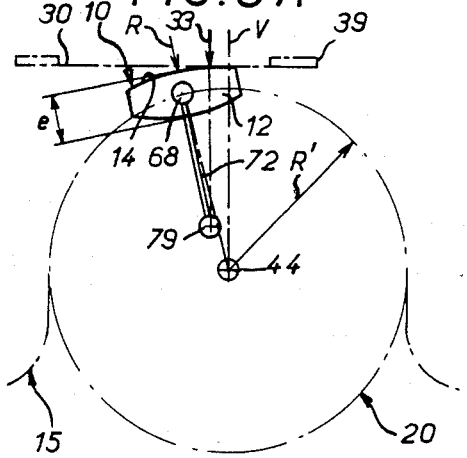
Figure 6B:
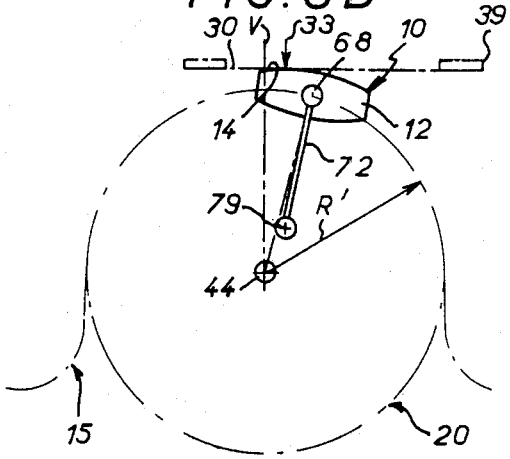
Figure 8:
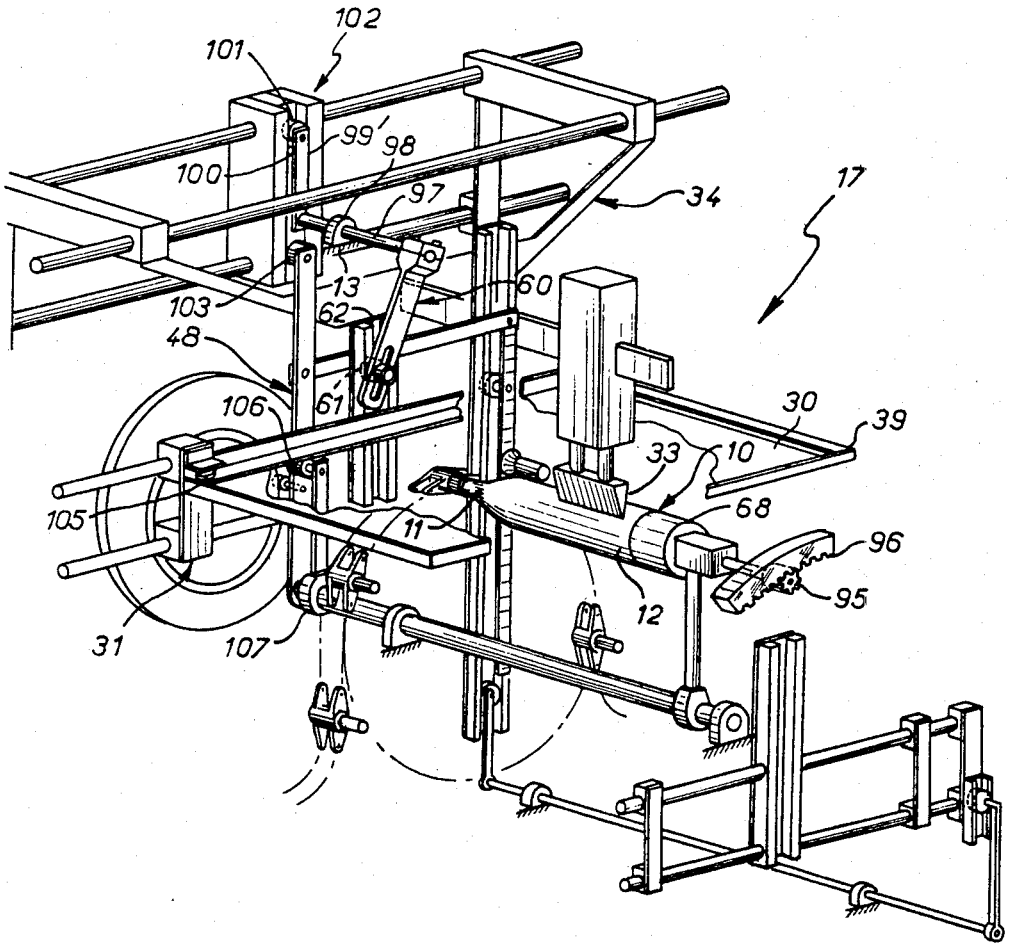

FIGS. 6A and 6B on the one hand and 7A and 7B on the other hand are respectively analogous views to those of FIGS. 5A and 5B, illustrating the adaptation of the printing machine in accordance with the invention to objects to be printed of oval transverse cross-section with different radii of curvature;

FIG. 8 is a view analogous to that of FIG. 1, relating to the adaptation of the printing machine in accordance with the invention to the printing of objects of circular transverse cross-section.

FIGS. 1 to 7 illustrate the application of the invention to the printing of bottles 10 of oval transverse cross-section.

In practice, these bottles are fabricated from a synthetic material.

Be this as it may, a bottle 10 of this kind comprises, overall, a neck 11 and a bottom 12.

For reasons of simplicity, the face 14 of a bottle 10 of this kind to be printed, or at least the median portion of this face actually intended to receive printing, will be considered here as equivalent to a portion of a cylindrical surface of radius R.

The printing machine in accordance with the invention comprises, naturally enough, a frame the design of which will be clear to those skilled in the art and which will therefore not be described in detail here.

For simplicity, those of the component parts of this frame which have been shown or schematically shown in the figures are all indicated by the general reference numeral 13.

Generally speaking, and in a manner known per se, the printing machine in accordance with the invention comprises, to serve at least one printing station 17, to be described in detail hereinafter, a conveyor 15 which carries at least one workholder 16 adapted to support a bottle 10 to be printed and, in practice, a plurality of spaced workholders 16 each adapted to support a bottle 10 to be printed.

A conveyor 15 of this kind is shown only partially and schematically in the figures.

It consists, for example, of two chains 18 which extend parallel to one another and between which are spaced workholders 16 replacing some of their links.

Only some of the workholders have been shown in the figures.

The resulting conveyor 15 is in practice a belt conveyor looped around at least two direction changing members, at least one of which is a driving member.

In practice, in the embodiment shown, the conveyor 15 thus passes around a direction changing member 20 at the printing station 17 and, for preference and as shown, this member is circular.

It consists, for example, of a toothed wheel mounted rotatably on frame 13 and having, at its perimeter, spaced openings adapted to permit the passage of the workholders 16.

On either side of this direction changing member 20, and at a lower level, there are two other direction changing members 21, in order to apply the conveyor 15 to the direction changing member 20 over the top half-circumference of the latter.

The direction changing members 21 are, for example, toothed wheels mounted rotatably on frame 13, like the direction changing member 20.

For the looping of the conveyor 15 on itself, further direction changing members, which are not shown on the figures, are naturally provided.

As mentioned hereinabove, at least one of direction changing members 20, 21 is a driving member.

This may be, for example, the direction changing member 20 which is keyed, possibly by a transmission device of any suitable kind, to the output shaft of a motor-gearbox unit 25 schematically represented in dashed outline in FIG. 1.

Be this as it may, the control means thus provided to drive in rotation the driving direction changing member of the conveyor 15 are adapted to rotate it continuously.

Thus the conveyor 15 advances continuously.

In the embodiment schematically represented, each workholder 16 comprises a tubular body 27 which is articulated, in the manner of a link and by lateral lugs 28, to the chains 18 constituting the conveyor 15, and which carries a projecting core member 29 on which a bottle 10 to be printed may be engaged by means of its neck 11.

As a workholder 16 of this kind does not of itself constitute part of the present invention, it will not be described in further detail here.

It is sufficient to indicate that the core member 29 which it comprises is preferably equipped with a retaining member adapted, by application against the inside wall of the neck 11 of the bottle 10 to be printed engaged on it, to firmly retain the bottle 10.

Be this as it may, when they are thus supported by the workholders 16, the bottles 10 to be printed extend transversely relative to the longitudinal displacement of the conveyor 15, that is to say parallel to the axes of the direction changing members 20, 21 thereof.

At the printing station 17, the printing machine in accordance with the invention comprises, on the one hand, a silk screen 30, forming a stencil, which is carried by a carriage 31, hereinafter referred to as the screen support carriage, and mounted to be movable longitudinally to-and-fro on a guide 32, and, on the other hand, a squeegee 33, carried by a carriage 34, which is also mounted to be movable longitudinally to-and-fro on a guide 35, parallel to the aforementioned guide.

In the embodiment shown in FIGS. 1 to 7, the guide 32 of the screen support carriage 31 comprises two parallel bars 37 which extend from one component part of the frame 13 to another, parallel to the conveyor 15.

Schematically speaking, the screen support carriage 31 comprises a frame 39 to support the screen 30 and two blocks 40 which, slidingly engaged on the bars 37 constituting the associated guide 32, support the frame 39.

Naturally, and in a manner known per se, the mounting of the screen 30 on its carriage 31 may be effected so as to permit raising of the screen 30 relative to the conveyor 15 when necessary, under the control of a piston-and-cylinder actuator, for example.

In the embodiment shown, the guide 35 of the squeegee support carriage 34 comprises three parallel bars 41 which extend from one component part of the frame 13 to another parallel to the conveyor 15, and thus parallel to the bars 37 constituting the guide 32 of the screen support carriage 31.

The squeegee 33, which extends transversely relative to the guide 35 of its carriage 34, is itself carried by an arm 43 attached to the latter.

Naturally, and in a manner known per se, the squeegee 33 is mounted so as to be movable transversely relative to the screen 30, so as to be movable away from it during its return movement following a printing operation.

Also, as previously, its mounting on the carriage 34 which supports it may involve means adapted to permit it to be raised when necessary, under the control of a piston-and-cylinder actuator, for example.

In a manner known per se, the screen support carriage 31 is controlled in synchronism with the squeegee support carriage 34, from a rotating shaft 44, hereinafter referred to as the oscillating shaft, which is coaxial with the direction changing member 20 and which is mounted to oscillate around its axis, in synchronism with the screen support carriage 31 and the squeegee support carriage 34, between two bearings 45 attached to the frame 13, under the control of a rotating cam 46 which is keyed, possibly through the intermediary of any suitable form of transmission device, to rotate with the output shaft of the motor-gearbox unit 25.

To this end, in the embodiment shown, there is keyed to the oscillating shaft 44 a lever 48 which, through the intermediary of engagement means, in practice a roller 49, meshes with a track 50 of the cam 46 on a face of the latter perpendicular to its axis of rotation.

In practice, and for reasons which will emerge hereinafter, the oscillating shaft 44 is in two parts 44A, 44B which mesh with one another by virtue of a splined coupling between, on the one hand, the part 44A and, on the other hand, a sleeve 52 to which the part 44B is keyed in rotation; whereas the part 44A, which is that carrying the lever 48, is fixed in the axial direction, the part 44B is axially movable to-and-fro, the sleeve 52 to which it is keyed meshing to this end, for example and by virtue of arrangements which are well-known per se and not shown in the figures, with a cam keyed to rotate with the output shaft of the motor-gearbox unit 25, the corresponding track of this cam being in this case on the edge of the latter, for example.

In the embodiment shown, the lever 48 forms one side of a deformable parallelogram the other side of which is constituted by a lever 54 which, by virtue of engagement means adjustable in position lengthwise, meshes with the squeegee support carriage 34.

In practice, the levers 48 and 54 are coupled together by a link 55 pivoted to each of them, and the lever 54 is keyed to a shaft 56 mounted to rotate in a bearing 53 attached to the frame 13.

By virtue of arrangements which will be described in more detail hereinafter in connection with other engagement means, the engagement means which are adjustable in position lengthwise of the lever 54 consist of a pin 57, in practice a rotatable roller, freely engaged in a slideway 58 which the squeegee support carriage 34 incorporates for this purpose, disposed vertically, that is to say perpendicularly to its guide 35.

By virtue of arrangements also to be described in more detail hereinafter in connection with another slideway, the slideway 58 on the squeegee support carriage 34 is simply formed by two parallel rulers on the squeegee support carriage 34.

In the embodiment shown in FIGS. 1 to 7, the oscillating shaft 44 is also keyed to a lever 60 which, by virtue of engagement means adjustable in position lengthwise, mesh directly with the screen support carriage 31.

By virtue of arrangements of the same type as those mentioned hereinabove, the engagement means adjustable in position lengthwise of this lever 60 consist of a pin 61, in practice a rotatable roller, freely engaged in a slideway 62 which the screen support carriage 31 incorporates for this purpose, disposed vertically, that is to say perpendicularly to its guide 32.

For preference, and for reasons which will emerge hereinafter, the lever 60 is demountable, so as to be removable from the oscillating shaft 44.

For example, it is engaged on this oscillating shaft 44, more precisely on the axially fixed part 44A of the latter, by a yoke 64 which is closed around said shaft 44 by a removable branch 65, said branch 65 being to this end, for example, attached by screws 66 to said yoke 64, for preference in line with a flat on said shaft 44.

Be this as it may, and as will be noted, it results from the foregoing that, in the embodiment shown in FIGS. 1 to 7, the screen support carriage 31 and the squeegee support carriage 44 are both, under the control of the oscillating shaft 44, movable in the same direction on their respective guides 32 and 35 when, as shown in FIG. 1, the roller constituting pin 57 is above the shaft 56.

At the printing station 17 the printing machine in accordance with the invention further comprises, in a manner known per se, a block 68, hereinafter referred to for convenience as the bearing block, which is intended to operate successively and in isolation on each of the bottles 10 to be printed and adapted, by bearing on the bottom 12 of a bottle 10 to be printed, to control its angular orientation relative to an axis transverse to guides 32, 35 of screen support carriage 31 and squeegee support carriage 34, this transverse axis being that along which the bottles 10 to be printed extend when they are supported, as described hereinabove, by the workholders 16 on the core members 29 of which they are engaged and therefore, in practice, the axis of the bottles 10 to be printed in the embodiment shown.

In practice, a bearing block 68 of this kind conforms to the configuration specific to the bottom 12 of the bottles 10 to print, so as to be able to engage at least partially with a bottom 12, its corresponding leading edge being preferably chamfered to facilitate such engagement.

As a bearing block 68 of this kind is well-known per se, and as it does not of itself constitute part of the present invention, it will not be described in more detail here.

It is merely necessary to indicate that it is carried by a support 69 on which it is rotatably mounted.

To this end, it is in practice supported by a shaft 70 rotatably mounted in said support 69, as can be seen in detail in FIG. 2.

This support 69 is itself carried by a lever 71 and the latter is keyed to rotate with the oscillating shaft 44, more precisely with the part 44B thereof which is axially movable to-and-fro.

In practice, in the embodiment specifically shown in FIG. 2, the support 69 and the lever 71 are duplicated: the support 69 is formed by two blocks 69A, 69B and the lever 71 by two arms 71A, 71B; the arm 71A, which carries the block 69A, is fixed in the axial direction, being rotatably mounted on the frame 13, by means of the bearing 45 of the oscillating shaft 44, whereas the arm 71B, which carries the block 69B, is keyed to rotate with, whilst being adjustable in position on, the part 44B of the oscillating shaft 44, and is therefore, like the latter, axially movable to-and-fro. The shaft 70 carrying the bearing block 68 is keyed to the block 69B in the axial direction, and is thus keyed in rotation and in the axial direction to the axially movable part 44B of the oscillating shaft 44 whereas, by virtue of a splined coupling, it passes slidably through the block 69A in the axial direction, while being keyed to the latter so as to rotate therewith; in practice this shaft 70 is itself in two parts 70A, 70B, linked together by an elastic coupling 92. Finally, to drive the arm 71A, the arm 71B is duplicated by an arm 90 which carries a finger 91 parallel to the oscillating shaft 44 and by means of which it is engaged with the arm 71A.

In practice, there are further provided on the frame 13 at the printing station 17 fixed slideways between which, on arriving at the printing station 17, the bottoms 12 of the bottles 10 to be printed engage, said fixed slideways being arranged so that the angular orientation of these bottles 10 around their axis is controlled so as to permit proper engagement of the rotary block 68 on their bottoms 12, allowing for the engagement tolerance which the latter already features, as mentioned hereinabove.

These fixed slideways are not visible in the figures.

In accordance with the invention, the bearing block 68 is keyed to rotate with a lever 72 which, by virtue of engagement means adjustable in position lengthwise, meshes with a carriage 73, hereinafter referred to for convenience as the control carriage, mounted so as to move on a guide 74 in synchronism with the squeegee support carriage 34.

In the embodiment shown, this control carriage 73 comprises two bars 76 which extend parallel to those 37, 41 constituting the guides 32, 35 of the screen support carriage 31 and squeegee support carriage 34, and the corresponding guide 74 consists of two brackets 77 which are spaced and parallel to one another, attached to the frame 13, and through which said bars 76 pass sliding fashion.

The lever 72 adapted to control the bearing block 68 is keyed to rotate with the shaft 70 supporting it and the lengthwise adjustable engagement means which the lever 72 carries consist of a pin 79, in practice a rotatable roller, freely engaged in a slideway 80 of the control carriage 73 which is disposed vertically, that is to say perpendicularly to bars 76.

In practice, for its adjustment in position, the rotatable roller constituting the pin 79 is carried by a shaft 81 which passes through a longitudinal slot 82 provided for this purpose in the lever 72, being lockable in position at any point on the latter by a nut 125 which, disposed on a first side of this lever 72, cooperates for retaining purposes with a head 83 on the other side of the latter.

Conjointly, the corresponding slideway 80 of the control carriage 73 consists of two vertical rails 123 attached to a support block 124 attached to the bars 76 which this control carriage 73 incorporates.

These arrangements, described here with reference to the lever 72, are equally applicable to all the levers in the machine in accordance with the invention provided with engagement means adjustable lengthwise, and the same applies to the associated slideways.

The squeegee support carriage 34 and the control carriage 73 of the bearing block 68 each have a slideway, these being parallel to one another.

In the case of the squeegee support carriage 34, this is the slideway 58, extended sufficiently downwards for this purpose; in the case of the control carriage 73 of the bearing block 68, this is a slideway 85 provided on this control carriage 73 for this purpose and disposed vertically, parallel to its slideway 80.

Conjointly, on a shaft 86 rotatably mounted in bearings 87 attached to the frame 13, there are keyed in rotation, parallel to one another, two cranks 88, 89 of the same length, one crank 88 meshing with the slideway 58 of the squeegee support carriage 34 and the other crank 89 meshing with the slideway 85 of the control carriage 73 of the bearing block 68.

For their meshing with their respective carriages, these cranks 88, 89 carry, as previously, a pin 93, 99, preferably in the form of a rotatable roller.

Hereinafter R′ designates the radius of the direction changing member 20 of the conveyor 15 at the printing station 17, or the radius of gyration of the circular path followed by the bottles 10 to be printed during their displacement at the printing station 17.

It will first be assumed that, as illustrated in FIGS. 5A, 5B, the radius of curvature R of the face 14 to be printed of the bottles 10 concerned is equal to the sum of the radius of gyration R′ and the half-thickness e/2 of these bottles, where e is their thickness.

The arrangement is such that, in this case, the roller 79 carried by the lever 72 to which is keyed the bearing block 68 is located in line with the oscillating shaft 44, in alignment therewith.

Conjointly, in this case, the roller 57 constituting the adjustable position engagement means carried by the lever 54 is disposed in line with the pivot 56 of this lever 54 on the frame 13.

The squeegee support carriage 34 is then immobile, as is also the control carriage 73.

When, carried by the conveyor 15, a bottle 10 to be printed arrives in line with the printing station 17, the bearing block 68, under the control of the axially movable part 44B of the oscillating shaft 44, is applied against the bottom 12 of this bottle 10, the latter having been appropriately prepositioned by the associated fixed slideways, in accordance with the arrangements previously described.

Driven at the radius of gyration R' by the conveyor 15, the bottle 10 concerned then comes into contact with the screen 30 along one generatrix of its face 14 to be printed (FIG. 5A).

It results from what has been said previously that, the face 14 to be printed generally forming part of a cylindrical surface of radius R centered on the oscillating shaft 44 around which the bottle 10 concerned gyrates, the latter is then developed without slipping in contact with the screen 39 (FIG. 5B) whereas the squeegee 33 remains immobile in line with its generatrix in contact with this screen 39, in the vertical plane, which, as shown schematically in dashed line in the figures, passes through the axis of the direction changing member 20.

Throughout the gyration of the object 10 in the course of printing around the axis of the oscillating shaft 44, the bearing block 68 applied against its bottom 12 firmly controls its angular orientation around its axis which, as mentioned hereinabove, extends transversely relative to the guides of the screen support carriage 32 and the squeegee support carriage 34, said axis being in practice that of said bearing block 68.

It will now be assumed, with reference to FIGS. 6A, 6B, that the radius of curvature R of the face to be printed 14 of the bottles 10 concerned is less than the sum of the radius of gyration R' of these bottles and their half-thickness e/2.

It is sufficient in this case, in accordance with the invention, to appropriately adjust the position of roller 79 on lever 72 and the position of roller 57 on lever 54.

This adjustment may be effected, for example, by means of a set of curves drawn up for this purpose according to the range of possible radii of curvature.

In practice, in the case in question of a radius of curvature which is less than the sum of the radius of gyration and half the thickness of the bottles concerned, the roller 79 is sumultaneously brought closer to the perimeter of the direction changing member 20 and the vertical plane V passing through the axis of the latter, so that it is then offset from the plane passing through the axis of the bearing block 68 and the axis of the direction changing member 20. Conjointly, the roller 57 is moved in consequence, above the shaft 56, to bring about appropriate displacement of the squeegee 33.

In accordance with the invention, the squeegee support carriage 34 being then movable in the same direction as the screen support carriage 31, as indicated hereinabove, the bottle 10 to be printed is then developed as appropriate in contact with the screen 30, as illustrated by FIGS. 6A, 6B, the roller 79 which in practice materializes the center of curvature of the face 14 to be printed moving parallel to the screen 30, in the same direction as the latter but with a shorter travel, and in synchronism with the squeegee 33.

In the course of its development in contact with the screen 30, the bottle 10 being printed is conjointly subject to a slight movement of rotation on itself, around its axis, under the control of the bearing block 68, which continuously controls its angular orientation relative to this axis.

Figure 7A:
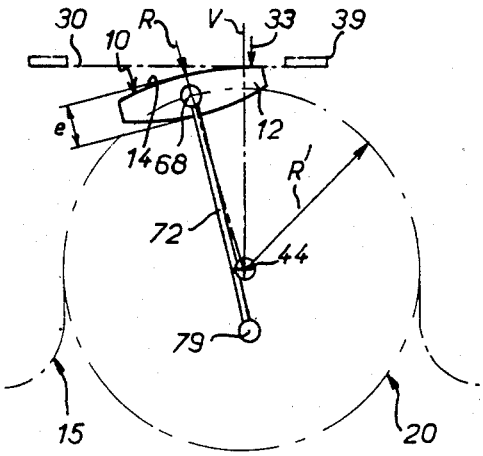
Figure 7B:
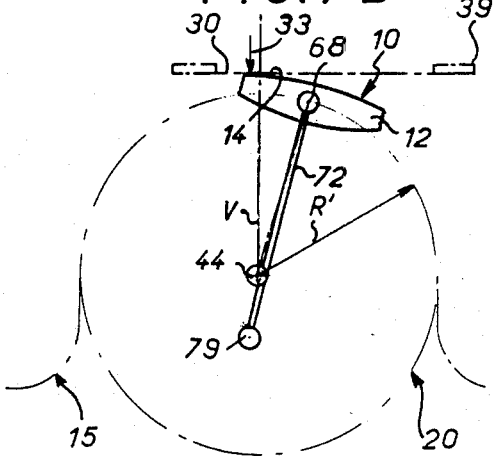

When, as illustrated in FIGS. 7A, 7B, the radius of curvature R of the face 14 to be printed of the bottles 10 concerned is greater than the sum of the radius of gyration R' and half their thickness, adjustments analogous to the previous adjustments are carried out, but the roller 79 is then moved away from the perimeter of the direction changing member whilst being, as previously, brought closer to the vertical plane V passing through the axis of the latter, whereas the roller 57 is placed beneath the shaft 56.

The squeegee support carriage 34 and the screen support carriage 31 then move in opposite directions relative to one another.

It will be appreciated that these adjustments are relative easy to carry out.

They enable the printing machine in accordance with the invention to be applied to the printing of bottles 10, and more generally any other objects, of oval transverse cross-section.

On completion of the printing of an object of this kind, and under the control of the axially movable part 44B of the oscillating shaft 44, the bearing block 68 moves away from the bottom 12 of the bottle 10.

The oscillating shaft 44 then returns the bearing block 68 to its initial position whilst, conjointly, the screen 30 and the squeegee 33 also return to their initial positions.

A new cycle can begin.

FIG. 8 illustrates the application of the printing machine in accordance with the invention to the printing of bottles 10 of circular transverse cross-section.

Thus, as will be noted, in accordance with the invention the bearing block 68 is mounted rotatably in a support 69 itself carried by a lever 71 directly mounted so as to be able to oscillate on the frame 13, this lever 71 being keyed to rotate with a shaft 44 also mounted to oscillate around its axis on said frame 13.

From the structural point of view, this results in minimal overhang, so that the assembly may offer high rigidity to guarantee precise work. From the operating point of view, the result is that, according to one characteristic of the invention, during the displacement of the screen support carriage 31, the squeegee 33, the axis of the bearing block 68 and the axis of the shaft 44 to which the support 69 of the latter is keyed are in substantially the same vertical plane.

In this case, the lever 72 to which the bearing block 68 is keyed in rotation is eliminated, this lever 72 being with advantage rendered demountable to this end, by virtue of arrangements as previously described in connection with the lever 60, and a gear 95 is substituted therefor, by virtue of arrangements which do not constitute part of the present invention and which will therefore not be described in detail here.

This gear 95 then meshes with a fixed rack 96 supported on the frame 13, which is curved and centered on the axis of the oscillating shaft 44.

Conjointly, the lever 60 controlling the screen support carriage 31 is keyed to rotate with an auxiliary shaft 97 which is mounted rotatably in a bearing 98 attached to the frame 13 and to which is keyed in rotation to a lever 99'

By virtue of engagement means consisting in practice of a pin 101, and more precisely of a rotatable roller, this lever 99' meshes with a vertical slideway 100 provided for this purpose on an auxiliary carriage 102 mounted to move on a guide parallel to the squeegee support carriage 34 and in synchronism with the latter.

In practice, this auxiliary carriage 102 is movably mounted on the bars 41 forming the guide 35 of the squeegee support carriage 34.

By means of its roller 61 the lever 60 engages, as previously, with the slideway 62 of the screen support carriage 31, this slideway 62 being extended upwardly to a sufficient extent.

Also, by means of a roller 103 the lever 48, also sufficiently extended upwardly for this purpose, meshes with the slideway 100 of the auxiliary carriage 102, to control the latter.

It results from what has been said previously that, as opposed to the previous arrangements, the screen support carriage 31 is in this case movable to-and-fro in the opposite direction to the squeegee support carriage 34, whilst being controlled in synchronism with the latter.

It also results from what has been said before that, at the printing station 17, the bearing block 68 ensures at least partial rotation on themselves of the objects 10 to be printed during their printing, this block 68 being provided to this end with a retractable pin which engages in a corresponding recess provided for this purpose in the bottom 12 of a bottle of this kind, in a manner well-known per se.

There is conjointly provided, for the screen 30, a compensation for the transverse displacement to which the bottles 10 to be printed are subjected at the printing station 17 by virtue of their circular paths.

To this end, the frame 39 of the screen 30 is mounted so as to be vertically movable on the carriage 31 which carries it, against the action of springs 105, and bears by its own weight on a roller 106 disposed at the end of a lever 107 itself keyed in rotation to the oscillating shaft 44.

As these arrangements do not of themselves constitute the object of the present invention, they will not be described in more detail here.

It will be understood that the present invention is not limited to the embodiments described and shown, but encompasses all variants in execution.

In particular, for adaptation to bottles or other objects of different thicknesses or diameters, the screen and the squeegee may normally, for preference, be mounted adjustable in height on the carriages which carry them.

Also, a number of printing stations may be provided along the conveyor utilized with, if required, other treatment stations between them, such as drying and/or curing stations.

However, as will be noted, the workholders always follow the same path, whatever the type and/or characteristics of the objects which they carry.

What we claim:

1. A silkscreen printing machine of the kind comprising at least one printing station, a conveyor carrying at least one workholder adapted to support an object to be printed and, at said printing station, a screen being carried by a screen support carriage which is mounted to be movable to-and-fro on a guide, a squeegee being carried by a squeegee support carriage which is mounted to be movable to-and-fro on a guide parallel to said screen support carriage guide, and a bearing block for bearing on the object to be printed and controlling its angular orientation relative to an axis transverse to the screen support carriage and squeegee support carriage guides, said bearing block being keyed to a first lever so as to rotate therewith, said first lever by virtue of engagement means being adjustable along its length and meshing with a control carriage mounted movably on a guide in synchronism with the squeegee support carriage.

2. A printing machine according to claim 1, wherein said squeegee support carriage and said bearing block control carriage have respective slideways parallel to one another, and two parallel cranks having the same length are keyed in rotation to a rotatable shaft, one of said parallel cranks meshes with the slideway of said squeegee support carriage and the other of said parallel cranks which meshes with the slideway of said bearing block control carriage.

3. A printing machine according to claim 1, wherein said screen support carriage is controlled in synchronism with said squeegee support carriage by a rotary shaft which is mounted so as to oscillate under the control of a cam and a second lever is keyed to said rotary shaft, said second lever which, by virtue of engagement means is adjustable along its length, and meshes directly with said screen support carriage.

4. A printing machine according to claim 3, wherein for the purposes of controlling oscillation of said rotary shaft, there is keyed for rotation to the latter a lever which, by virtue of engagement means, meshes with the associated cam, said lever forming one of the sides of a deformable parallelogram of which the opposite side consists of a lever which, by virtue of engagement means adjustable in position lengthwise, meshes with the squeegee support carriage.

5. A printing machine according to claim 1, wherein a second lever meshes with said screen support carriage, said second lever is demountable and adapted to be keyed for rotation with an auxiliary shaft which is keyed for rotation with a third lever which meshes with an auxiliary carriage mounted so as to be movable parallel to said squeegee support carriage and in synchronism therewith, and in which, conjointly, said first lever keyed in rotation to said bearing block is also demountable, so that there may be substituted therefor a gear meshing with a fixed curved rack which is centered on said rotary shaft.

6. A printing machine according to claim 1, wherein the engagement means carried by said first lever consist of a pin freely engaged in a slideway carried by said bearing block.

7. A printing machine according to claim 1, wherein at the printing station, the conveyor, which is of the continuous feed type, passes over a circular direction changing member, and in which the bearing block is carried by a support keyed in rotation to a shaft which is coaxial with said direction changing member and mounted so as to oscillate in synchronism with the squeegee support carriage and the screen support carriage.

8. A printing machine according to claim 7, wherein during displacement of the screen support carriage, the squeegee, the axis of the bearing block and the axis of the shaft to which the support of the latter is keyed move into a common vertical plane.

9. A printing machine according to claim 1, wherein the bearing block is mounted rotatably in its support and said support is itself carried by a lever keyed in rotation to a shaft mounted so as to oscillate around its axis on the frame of the machine.

10. A printing machine according to claim 1, wherein the bearing block is mounted rotatably in its support and said support is itself carried by a lever which is directly oscillatingly mounted on the frame of the machine and which is adapted to impart to it a path of movement which is the image of that of the conveyor at the printing station.

* * * * *